US010465673B2

(12) United States Patent
Ackermann et al.

(10) Patent No.: US 10,465,673 B2
(45) Date of Patent: Nov. 5, 2019

(54) PERISTALTIC PUMP HAVING REDUCED PULSATION AND USE OF THE PERISTALTIC PUMP

(71) Applicant: BAUSCH + STRÖBEL MASCHINENFABRIK ILSHOFEN GMBH + CO. KG, Ilshofen (DE)

(72) Inventors: Simon Ackermann, Frankenhardt (DE); Harald Bauer, Wolpertshausen (DE)

(73) Assignee: BAUSCH + STRÖBEL MASCHINENFABRIK ILSHOFEN GMBH + CO. KG, Ilshofen (DE)

( * ) Notice: Subject to any disclaimer, the term of this patent is extended or adjusted under 35 U.S.C. 154(b) by 583 days.

(21) Appl. No.: 14/895,988

(22) PCT Filed: Jun. 6, 2014

(86) PCT No.: PCT/EP2014/061864

§ 371 (c)(1),
(2) Date: Dec. 4, 2015

(87) PCT Pub. No.: WO2014/195475

PCT Pub. Date: Dec. 11, 2014

(65) Prior Publication Data

US 2016/0123317 A1 May 5, 2016

(30) Foreign Application Priority Data

Jun. 6, 2013 (DE) ..... 10 2013 210 548

(51) Int. Cl.
*F04B 43/12* (2006.01)
*F04B 11/00* (2006.01)

(52) U.S. Cl.
CPC ..... *F04B 43/12* (2013.01); *F04B 11/00* (2013.01)

(58) Field of Classification Search
CPC ..... F04B 11/00; F04B 11/0091; F04B 43/12; F04B 43/1253; F04B 43/1261; F04B 43/1276; F04B 43/1284
See application file for complete search history.

(56) References Cited

U.S. PATENT DOCUMENTS 2,804,023 A * 8/1957 Lee ..... F04B 43/1276 417/477.7
2,909,125 A 10/1959 Daniels
(Continued)

FOREIGN PATENT DOCUMENTS

DE 2200595 7/1973
DE 100309 9/1973
(Continued)

*Primary Examiner* — Patrick Hamo
*Assistant Examiner* — Joseph S. Herrmann
(74) *Attorney, Agent, or Firm* — Kilpatrick Townsend & Stockton LLP

(57) ABSTRACT

The invention relates to a peristaltic pump (1) comprising a saddle and a rotor (3) rotatable therein, between which a hose (4) is arranged. The rotor (3) carries hose compression means (6), which sweep over the hose (4) with the rotation of the rotor (3) and thus convey a conveying fluid. When the hose compression means (6) emerge from the hose (4), this results in pulsation effects. According to the invention, these pulsation effects are suppressed in that an inner saddle face (5), on which the hose (4) is positioned, is suitably shaped. In addition, the pulsation effects may be reduced or prevented by controlled adaptation of the rotor rotational speed, by suitable selection of a conveying end position during metering of the pumping medium, or by establishing particular invariable conveying end positions. The use of a peristaltic pump (1) of this type for metering is further proposed.

11 Claims, 6 Drawing Sheets

(56) References Cited

U.S. PATENT DOCUMENTS

Figure 1:
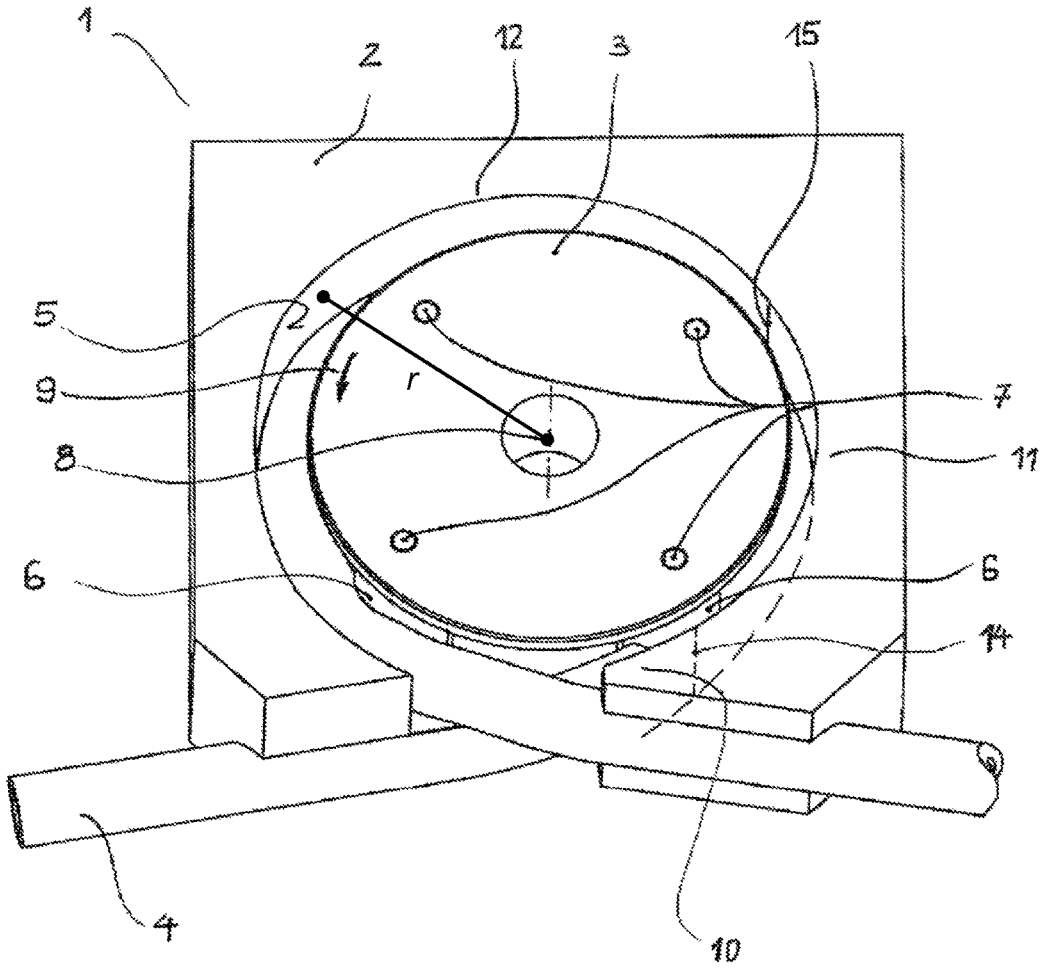

| | | | | | |
|---|---|---|---|---|---|
| 2,965,041 | A | * | 12/1960 | Clark | F04B 43/0072<br>417/477.11 |
| 3,756,752 | A | * | 9/1973 | Stenner | F04B 43/1253<br>226/91 |
| 4,518,327 | A | * | 5/1985 | Hackman | F04B 43/1253<br>417/477.3 |
| 4,564,342 | A | * | 1/1986 | Weber | F04B 43/1276<br>417/477.6 |
| 4,673,334 | A | * | 6/1987 | Allington | F04B 43/1292<br>417/475 |
| 4,705,464 | A | * | 11/1987 | Arimond | F04B 43/1276<br>417/477.12 |
| 5,230,614 | A | * | 7/1993 | Zanger | F04B 43/1284<br>417/477.9 |
| 7,918,657 | B2 | * | 4/2011 | Bobo | F04B 43/1253<br>384/548 |
| 8,157,547 | B2 | | 4/2012 | Hendrikus Oude Vrielink | |

FOREIGN PATENT DOCUMENTS

| | | |
|---|---|---|
| DE | 3326786 | 2/1985 |
| DE | 3726452 | 2/1989 |
| DE | 3940730 | 7/1991 |
| DE | 19611637 | 10/1997 |
| DE | 20109803 | 11/2002 |
| JP | H05-044656 | 2/1993 |
| JP | 2007298034 | 11/2007 |
| WO | 9914497 | 3/1999 |
| WO | 2009095358 | 8/2009 |

* cited by examiner

12

PERISTALTIC PUMP HAVING REDUCED PULSATION AND USE OF THE PERISTALTIC PUMP

CROSS REFERENCE TO RELATED APPLICATION

This application is a national stage application under 35 U.S.C. § 371 of PCT/EP2014/061864 filed Jun. 6, 2014, which claims priority to German application no. 10 2013 210 548.7 filed Jun. 6, 2013, the disclosures of which are hereby incorporated by reference herein in their entireties.

The present invention relates to a peristaltic pump for conveying a fluid pumping medium through a hose, comprising a saddle having an arc-shaped inner saddle face and a rotor which is arranged in the saddle so it can rotate about an axis of rotation and has a plurality of hose compression means, which are angularly distributed around the axis of rotation and arranged opposing the inner saddle face at least at times, for externally loading a hose, which is to be arranged between the inner saddle face and the rotor, in such a way that when the rotor rotates a particular local constriction of the throughput cross section of the hose, which is caused by external loading of the hose by a hose compression means, is movable along the inner saddle face using the relevant hose compression means so as to convey the pumping medium in the hose, the saddle comprising, in the stated order along the inner saddle face, an immersion region along the inner saddle face of preferably 30°, a sealing region over an angular range of the inner saddle face which is at least as large as the distance between two hose compression means, and an emergence region for the hose compression means, and the radial distance between the axis of rotation of the rotor and the inner saddle face decreasing in the immersion region and increasing in the emergence region in such a way that the hose compression means, during the movement thereof through the immersion region, can increasingly load the hose so as to constrict the throughput cross section thereof, and, during the movement thereof through the emergence region, can relieve the hose to remove or at least reduce the particular constriction. The invention further relates to a use of the peristaltic pump.

For conveying fluid pumping media, it is known to use hose pumps which are equipped with a hose compression means, which may for example be in the form of a sliding shoe or a roller. The hose compression means can obturate the hose, which is located in a gap between the rotor and the inside of a saddle. The pumping medium is conveyed by the forward movement of the obturation point. In the process, a hose compression means is immersed in the hose in an immersion region until it ultimately increasingly obturates said hose in the transition to the sealing region. The obturation produced in the sealing region is displaced along the hose by the rotor and the hose compression means, resulting in the conveying effect of the hose pump. The length of the sealing region extends at least over a portion of the hose which corresponds to the distance between two successive hose compression means along the conveying path thereof. From the transition of the sealing region into the emergence region on the output side of the peristaltic pump, the obturation point in the hose is opened in that the open hose compression means emerges from the hose and opens the obturation point again. In this process, the internal volume of the hose increases at the obturation point or in the vicinity of the obturation point. While the hose is compressed and obturated, the internal volume thereof is reduced, whereas when the hose compression means has completely emerged from the hose, the hose takes on the normal cross section thereof and has a much larger internal volume in the relevant region than when obturated. As a result of this increase in the internal volume, a return suction effect occurs when the hose compression means emerges. A further hose compression means, downstream from the emerged hose compression means, obturates the hose between an entry region into the pump for conveying fluid and an exit region at which the emergence takes place. The increase in the internal volume or the return suction effect in the exit region thus only acts on the output side of the pump. This has the result that previously conveyed conveying fluid is sucked back into the pump. If the conveyance is considered as a continuous process, it can be seen that the return suction effect occurs periodically every time a hose compression means emerges from the hose. Repeated return suction effects make the volume flow through the pump non-uniform and are referred to in the following as pulsation effects. Depending on the duration or the angular range of the rotation of the rotor in which the emergence takes place, different dynamics for the return suction effect occur. This may for example take place over a short or long angular range.

In the prior art, to smooth out the return suction effect, a large number of hose compression means have been used on a rotor. However, this has the drawback that the large number of hose compression means place a heavy load on the hose. This leads to increased abrasion, which is undesirable in particular in the inside of the hose, since it can contaminate the pumping medium. It is further known in the prior art to use not just one conveying hose but rather two hoses operated in parallel, which are passed over by hose compression means of the rotor which act in a mutually offset manner in terms of phase. The two hoses in the pump are typically combined into a single supply or removal hose of the pump upstream and downstream from the pump by a Y-piece in each case. The further increase in and the phase offset of the hose compression means on the rotor result in improved smoothing of the return suction effect and corresponding pulsation effects in operation.

DE 196 11 637 B4 proposes increasing the angular speed of the rotor while a hose compression means is emerging from the hose, so as to compensate the return suction effect due to the expanding hose. For this purpose, an angle transmitter is connected to the rotor, the speed changes of the rotor being controlled as a function of angle using the measurement result thereof. At high production speeds, however, this may be complex in terms of control and energy-intensive as a result of the required accelerations. In some cases, only low rotor speeds can be achieved. WO 2009/095358 proposes a further compensation option for the pulsation effects resulting from the expanding hose. For this purpose, the hose is guided along an inner saddle face which has a non-constant radius. For the hose compression means to be able to still hold the hose obturated over the inner saddle face, they are resiliently prestressed in such a way that they can bridge some change in the distance between the inner saddle face and the axis of rotation of the rotor. When the hose compression means are displaced further away from the axis of rotation of the rotor, the speed thereof increases, in such a way that the return suction effect can be compensated by an increased conveyance of pumping medium. DE 24 52 771 A1 discloses a similar compensation method, but the speed differences are not brought about by the saddle shape, but rather by an axis of rotation of the rotor which is arranged eccentrically with respect to the centre of a saddle. Radially displaceable hose compression means are also arranged in the rotor, and extend further from the rotor at the points where the axis of rotation of the rotor is at a greater distance from the inner saddle face, whilst they retract further at points having a smaller distance between the axis of rotation of the rotor and the inner saddle face. Accordingly, this results in different speeds of the individual hose compression means onto the hose. These are configured in such a way that the increased conveyance outside the emergence region of a hose compression means compensates the return suction effect. A drawback of these last two solutions is that the hose compression means have to be movable in the rotor, and this leads to abrasion and to a higher probability of the pump failing.

The object of the present invention is to overcome the drawbacks of the prior art and to find a mechanically simple and reliable solution for preventing pulsation effects, which can be used even at high production speeds to the greatest possible extent.

A first aspect of the invention relates to a peristaltic pump in which the hose compression means are provided so as to be angularly spaced on the rotor in such a way, and the emergence region extends around the axis of rotation of the rotor over such an angular range, that in each case a hose compression means can be in the emergence region during the rotation of the rotor, the inner saddle face extending in the emergence region in such a way that the radial distance between the inner saddle face and the axis of rotation of the rotor varies along the movement path of the hose compression means in such a way that the load on the hose from the hose compression means is modulated upon passing through the emergence region, in such a way that the internal volume of the hose at the point of the load from the hose compression means increases at least approximately uniformly.

An advantage of this solution is that a mechanically simple construction can be selected, whilst smoothing of the pulsation effects is still possible. The pulsation is compensated when the internal volume of the hose at a hose compression means increases uniformly during the emergence thereof. This is possible if the speed of the emergence is selected in such a way that the volume increases uniformly. In this context, care should be taken that the volume of a compressed hose does not increase linearly with the emergence distance of a hose compression means from the hose, but rather increases more strongly at the start of the relief and less strongly as the emergence increases. Varying the radial distance between the inner saddle face and the axis of rotation of the rotor in a manner which takes this into account makes it possible for the hose compression means to accordingly emerge from the hose very slowly initially. As the emergence increases, the emergence speed subsequently also increases, for example in the form of an exponential function. For hose compression means of which the radius in the rotor is fixed, a corresponding emergence speed can be implemented by way of the shape of the inner saddle face. At a constant speed, an inner saddle face of this type having a hose compression means passing through an emergence region leads to a constant volume flow of the pumping medium.

In one embodiment of the peristaltic pump, the hose compression means are distributed around the axis of rotation of the rotor at equal angular distances from one another, and the length of the emergence region corresponds to the angular distance between two hose compression means in the rotor. In this way, when the hose is completely released by a hose compression means, a further, downstream hose compression means enters the emergence region and starts to emerge in such a way that the volume flow ejected from the pump is constant. Since this process is repeated continuously and preferably so as to mesh seamlessly, a constant rotational speed of the rotor results in a uniform volume flow from the pump. With the rotor looping around the hose by at most 360°, it is possible to construct a peristaltic pump of this type using two hose compression means. For looping by a smaller amount, a construction using three hose compression means is possible. Naturally, more hose compression means are also conceivable. There must always be at least one hose compression means obturating the hose to make reliable conveyance possible.

In a further embodiment of the peristaltic pump, a progression of the radial distance between the inner saddle face and the axis of rotation of the rotor follows a linear function, a polynomial or an exponential function along at least parts of the emergence region, without modulation. As a result of a function of this type, a hose compression means emerges continuously from the hose, a polynomial or exponential function bringing about part of the aforementioned compensation of pulsation effects. Remaining errors can be compensated by an additional modulation.

In a further embodiment of the peristaltic pump, the radial distance between the inner saddle face and the axis of rotation of the rotor follows a modulation along the emergence region along the movement path of the hose compression means over a uniform increase in the radial distance, in such a way that the modulation compensates a non-uniform increase in the internal volume of the hose using a radial distance between the inner saddle face and the axis of rotation of the rotor by way of correspondingly stronger or weaker loading by the hose compression means.

In a further embodiment of the peristaltic pump, the modulation of the radial distance between the inner saddle face and the axis of rotation of the rotor is established by a measurement on a similar peristaltic pump without modulation of the inner saddle face, in such a way that pulsation effects in the pumping medium measured on the peristaltic pump without modulation are compensated by counteracting modulation. Although it is possible to achieve smoothing of the outgoing volume flow by way of for example a polynomial or exponential progression of the emergence over the emergence region, the smoothing can be optimised in that a remaining pulsation is measured on a pump which has not yet been definitively optimised and the measurement result is exploited for the compensation by way of the shape of the inner saddle face. In particular, this exploitation takes into account the relationship between the emergence distance of a hose compression means from the hose and the increase in volume in the hose, so as to derive a suitable geometry of an inner saddle face from the measured pulsation effects.

A further aspect of the present invention proposes a peristaltic pump according to claim 1, in which the hose compression means are provided so as to be angularly spaced on the rotor in such a way, and the emergence region extends around the axis of rotation of the rotor over such an angular range, that in each case at least two hose compression means in succession can be in the emergence region during the rotation of the rotor, the inner saddle face extending in the emergence region in such a way that the radial distance between the inner saddle face and the axis of rotation of the rotor varies along the movement path of the hose compression means in such a way that the load on the hose from the hose compression means is modulated upon passing through the emergence region, in such a way that pulsation effects, which occur in the pumping medium as a result of the change in the load on the hose from one of the two hose compression means respectively passing through the emergence region together, are compensated at least in part by a change in the load on the hose from the other of the two hose compression means respectively passing through the emergence region together upon passing through the emergence region.

As explained previously, pulsations can occur in that the emergence of hose compression means from the hose takes place in a uniform manner, but has a non-uniform effect on the increase in the internal volume of the hose. This results in the aforementioned return suction effect and in a non-uniform volume flow from the peristaltic pump. Compensating a non-uniform volume flow of this type, due to pulsation effects, using a second hose compression means may be simpler than directly smoothing the outgoing volume flow, in particular if precise specifications would have to be adhered to for small emergence distances for compensation. Since there always have to be two hose compression means immersed in the hose to implement this aspect of the invention, corresponding looping of the rotor of the peristaltic pump is required. For three hose compression means in the rotor, an emergence region of at least 240°, whilst for four hose compression means 180° of emergence region are required. As disclosed previously in relation to direct compensation in accordance with the aforementioned aspects of the invention, in a variant it is preferred to distribute the hose compression means around the axis of rotation of the rotor at the same angular distances from one another and to set the length of the emergence region at twice the angular distance between two hose compression means in the rotor. In this case, when a compensation cycle using two hose compression means ends, a further compensation cycle begins, in which a hose compression means travelling out of the emergence region is replaced with a hose compression means newly travelling into the emergence region.

In a further embodiment of the peristaltic pump, the inner saddle face comprises an input portion of the emergence region, which is passed through by one of the two successive hose compression means, the radial distance between the inner saddle face and the axis of rotation of the rotor increasing continuously along the input portion, and a compensation portion, which, simultaneously with the input portion being passed through by one hose compression means, is passed through by the other of the successive hose compression means, and which has a modulation of the radial distance between the inner saddle face and the axis of rotation of the rotor along the compensation portion, pulsation effects, which occur in the pumping medium as a result of the change in the load on the hose from the hose compression means in the input portion, being compensated by the modulation. Although it is in principle conceivable to provide for example two mutually complementary compensation portions in the emergence region, it is preferred to use an input region of a simple configuration and a compensation region matched thereto. Accordingly, if more pumping medium than average is being absorbed by the increase in internal volume of the hose in the input portion, the compensation portion is preferably configured in such a way that it subsequently brings about a compression of the hose, which provides a corresponding amount of conveying fluid in such a way that there is no pulsation effect towards the outside of the pump.

In a further embodiment, the input portion is arranged in the emergence region in such a way that it is passed through by the hose compression means before the compensation region is passed through. Since, at least in hoses having a circular cross section, the increase in the internal volume from the completely compressed state is the strongest, the strongest pulsation is produced when a hose compression means reaches the emergence region and begins to open the hose. To provide compensation in this context, very precise control of the emergence process would be required. It is therefore easier to provide simple, uniform emergence and to arrange the compensation portion downstream, in the pass-through direction, from the input portion which is passed through first.

As a development, it is proposed for a conveying portion, which is comprised by the sealing region and has a constant radial distance between the axis of rotation of the rotor and the inner saddle face, the input portion, and the compensation portion to be dimensioned in such a way that they are passed through simultaneously and without interruption by respective hose compression means when the rotor rotates, a hose compression means in each case being able to load the hose in each of said portions, and for the conveying portion, the input portion and the compensation portion to extend around the axis of rotation of the rotor over equally large angular distances.

In a further embodiment of the peristaltic pump, a progression of the radial distance between the inner saddle face and the axis of rotation of the rotor follows a linear function, a polynomial or an exponential function along at least parts of the emergence region, without modulation. Progressions of this type are simple to calculate, and corresponding saddles are simple to produce and provide a reproducible emergence process of a hose compression means from the hose. As was explained previously in relation to the first aspect of the present invention, the non-uniformity of the volume flow, which persists in spite of a compensation means for a progression of this type which may already be present, can be compensated by a corresponding compensation region for a second hose compression means in the emergence region.

In a further embodiment of the peristaltic pump, the modulation of the radial distance between the inner saddle face and the axis of rotation of the rotor extends along the compensation portion at least approximately sinusoidally. Experiments have shown that a uniform emergence of a hose compression means from the hose in the input region, without compensation by a compensation region, leads to a substantially sinusoidally progressing pulsation effect in the volume flow from the pump. Accordingly, it is expedient to provide the compensation portion with a correspondingly counteracting at least approximately sinusoidal surface modulation of the inner saddle face. This has been found to be particularly advantageous in hoses having a circular cross section.

In a further embodiment of the peristaltic pump, a distance-enlarging half-wave of the at least approximately sinusoidal modulation, which increases the radial distance between the inner saddle face and the axis of rotation of the rotor as a hose compression means passes through the compensation portion, is arranged upstream, in terms of a hose compression means passing through, from a distance-reducing half-wave, which decreases the radial distance between the inner saddle face and the axis of rotation of the rotor as a hose compression means passes through the compensation portion. Thus, the input portion is followed first by the distance-enlarging half-wave and subsequently by the distance-reducing half-waves, the two half-waves forming the compensation portion. This arrangement is particularly suitable for hoses having a circular cross section and uniform increase in the radial distance between the inner saddle face and the axis of rotation of the rotor in the input portion. The terms "distance reduction" and "distance enlargement", in relation to the half-waves, each refer to an average value of the at least approximate sine function, it being possible to superpose the average value for example of a linear function. The distance-reducing half-wave compresses the hose in the compensation portion in such a way that pumping medium is provided which can be received as a result of the large increase in the internal volume at the hose compression means in the input portion, in such a way that pulsation towards the outside of the pump is reduced. Conversely, as the distance-enlarging half-wave comprising a hose compression means passes through, the internal volume at the compression point in the compensation portion is increased, in such a way that a smaller increase in the internal volume in the input portion is compensated to provide a volume flow which is uniform overall. Preferably, the shape of the two half-waves is adapted to a hose type having a particular internal diameter, in particular having a circular cross section, and optimally suited thereto.

In a further embodiment of the peristaltic pump, the modulation of the radial distance between the inner saddle face and the axis of rotation of the rotor along the compensation portion is established by way of a measurement on a similar peristaltic pump without modulation of the compensation portion, in such a way that pulsation effects in the pumping medium measured on the peristaltic pump without modulation of the compensation portion can be compensated by counteracting modulation in the compensation portion. As a result of this mode of operation, the pulsation can be optimally corrected, since the compensation is based on actually measured values. A measurement may for example be taken by weighing out the conveyed pumping medium. Preferably, a measurement of this type is repeated a plurality of times and the arithmetic mean of the measurement values is taken for individual angular positions of the rotor. When the required correction shape is calculated, a relationship between fluctuations in the volume flow and the shape of the inner saddle face is preferably taken into account, and in this context in particular the relationship between the extent of the compression of the hose and the associated internal volume of the hose. Preferably, a linear increase in the radial distance between the inner saddle face and the axis of rotation of the rotor is brought about in the input portion. Particularly preferably, the rotor comprises four hose compression means, in particular in the form of rollers. Accordingly, the angular extent of the emergence region is preferably 180°. This is also preferred for all other embodiments of this aspect of the invention. Preferably, compensation according to this embodiment is implemented individually in each case for different hose diameters and for respectively correspondingly compensated saddles which are respectively suitable for a corresponding hose. Preferably, the saddle is easily replaceable in the peristaltic pump, in such a way that the pump is easily adaptable to a different hose type.

In a further aspect of the invention, the peristaltic pump of the generic type mentioned at the outset is further developed in that a pulsation sensor is provided in the pump, detects pulsation effects in the pumping medium and counters the pulsation effects by varying a rotational speed of the rotor. In the prior art, it has been proposed to counter the pulsation effects by changing the rotational speed of the rotor, but these changes are based on a fixed pattern in which a particular speed or a drive current or drive frequency is assigned to each angular position of the rotor. An angle sensor is required for this purpose. According to the invention, a control system should be implemented which reacts to actually occurring pulsation effects and corrects them by changing the speed of the rotor. It is advantageous that a solution of this type works independently of the hose type used. In this context, a volume flow measurement or a pressure measurement in the conveying fluid is conceivable as a pulsation sensor, or external deformations such as the diameter or expansions can be measured on the hose so as to obtain a measure of the pulsation effects. Further solutions known to the person skilled in the art for determining the pulsations are also conceivable.

A further aspect of the invention proposes a peristaltic pump of the generic type mentioned at the outset which is developed in that the pump is set up to compensate pulsation effects in the conveying fluid, when metering an amount of a conveying fluid, in that a conveying end position of the rotor at the end of metering is shifted forwards or backwards with respect to an uncompensated conveying end position by a control device. Assuming that it is known what pulsation effect is present in what angular position of the rotor, it is possible to determine the conveying end in advance in such way that a deviation from a uniform volume flow from the pump can be compensated. For example, for this purpose the conveying end position is shifted forwards if the pulsation results in too little volume being conveyed, whilst the conveying end position is shifted backwards to compensate an excessive conveying volume flow. The extent of the forward or backward shift can be calculated by means of the known volume flow from the pump. Conventionally, during metering, the rotor follows speed profiles having a starting ramp, in which the rotor is accelerated, followed by a phase of constant rotational speed and subsequently a stopping ramp, in which the rotor is braked from the constant rotational speed until stationary. The compensation can be achieved by changing the steepness of the starting or stopping ramp or lengthening or shortening the phase of constant rotational speed, and in each case this shifts the conveying end position.

This corresponds to a compensation by the conveying path of the rotor. In a variant, the target position for the next metering is calculated after the end of the previous metering. In this context, the last conveying end position and the effect of the pulsation effect associated with this position can be taken into account. Completely generally, a change in the volume flow from the pump can be integrated over the entire metering process, and the result of this integration can be compensated. In particular, the calculation of the compensation amount and the corresponding shift in the conveying end position can be carried out as a function of the hose type used.

In one embodiment of this peristaltic pump, a control device determines an extent and a direction of the shift in the conveying end position of the rotor for compensation at least approximately by means of a sine function which is dependent on the uncompensated conveying end position. Thus, an ideally uniform conveying volume flow is assumed, a theoretical conveying end position is calculated therefrom, and compensation is subsequently carried out using a sine function. The value of the sine function used for the compensation is determined from the theoretical conveying end position. In a development of this peristaltic pump, the sine function is adjustable in terms of the phase position, amplitude, frequency and offset thereof. To adjust the phase position, an angular offset from the angle of the uncompensated conveying end position can be added. The amplitude can be adjusted by multiplying the result. The frequency of the sine function can be adjusted using a factor by which the angle of the uncompensated conveying end position is multiplied. An offset can be adjusted by adding or subtracting an offset value to or from the result of the aforementioned operations. These adjustment values may be dependent on the hose type, the saddle type and an excess compression of the hose. Excess compression of the hose means that the hose is compressed further beyond the extent of the compression at which the hose is closed. Corresponding values may be stored in and retrievable from the control device.

In a further aspect of the invention, a peristaltic pump having the features mentioned at the outset is proposed which is developed in that the hose compression means are uniformly angularly distributed around the axis of rotation of the rotor, and the control device controls the pump in such a way that for metering the rotor takes on a conveying end position at an angular distance from a previous conveying end position, the angular distance corresponding to the angle between two adjacent hose compression means on the rotor or a multiple thereof. Pulsation effects typically occur in a particular pattern when a hose compression means is passing through the emergence region and repeat when the following hose compression means passes through. Thus, if the same angular position of a hose compression means is always maintained when it passes through the emergence region (conveying end position), this results in a constant volume in each case which has been conveyed between the last conveying end position in the same angular position of a previous hose compression means and the current conveying end position. Special compensation of errors in the conveying amount can thus be omitted. A drawback is that only discrete conveying amounts can be conveyed. It is therefore preferred to use particularly thin hoses, in such a way that the discretisation is as fine as possible. Further, the discretisation can be made finer by selecting a high number of hose compression means on the rotor. This embodiment may be combined with features of the other embodiments, in particular if this results in synergistic advantageous. Particularly preferably, three, four, five or six rollers are provided on the rotor as hose compression means. Particularly preferably, a hose is selected to be sufficiently thin that the angle of rotation is a maximum for the metered amount to be conveyed. The larger this angle of rotation, the more precise the metering. In general, and independently of this embodiment, a conveyed amount can be weighed using a weighing machine. Typically, to determine a conveying characteristic, weighing is carried out after each 1° change in the angle of the rotor.

It is common to all the aforementioned aspects of the invention that corresponding peristaltic pumps are configured for the use of exactly one hose. As a result, Y-pieces, required in the prior art as splitters for a plurality of hoses laid between the rotor and the saddle, can be omitted. Further, a symmetrical construction of the pump is possible, in other words such that the rotor of the pump can be operated clockwise or anticlockwise. For this purpose, the inner saddle face is preferably provided, about a centre, with two emergence regions, of which one acts as an emergence region and one as an immersion region in each direction of rotation. The immersion region is passed through by hose compression means in a direction counter to the pass-through direction through the emergence region. The emergence regions are preferably formed symmetrically about the centre. In this case, the sealing region preferably extends over the centre.

A further advantage of the pump having one hose is that the precision of the conveying amount cannot be impaired by different hose lengths of a plurality of hoses. Not least, a pump having only one hose produces less abraded material which can mix into the pumping medium.

In a further embodiment of the peristaltic pump, the distances of the hose compression means in the rotor from an axis of rotation of the rotor are constant. This is applicable to all embodiments and all aspects of the present invention. A fixed arrangement of the hose compression means in the rotor results in a particularly robust and low-abrasion embodiment of the peristaltic pump.

In a further embodiment of the peristaltic pump, the saddle of the peristaltic pump is divisible into two sub-portions. Aside from the possibility of combining this embodiment with other embodiments of the peristaltic pump, this embodiment and developments thereof are also of independent significance. The applicant reserves the right to claim this embodiment and/or developments thereof independently. This aspect has the purpose of being able to remove the sub-portions of the saddle from one another, meaning that portions of the inner saddle face belonging to a particular sub-portion can be removed from one or more hose compression means. As a result, obturation of the hose as a result of the hose compression means being immersed in the hose can be eliminated, in such a way that unimpeded passage of fluid through the hose is possible. When the saddle is open, and the sub-portions are at a sufficient distance to release a flow of fluid through the hose, the conveying effect of the peristaltic pump can be suspended and/or the hose can be rinsed using a rinsing fluid, for example a rinsing gas. Moreover, opening the saddle may provide a safety function for the pump in case undesired conveying should take place by mistake.

A further advantage is that when the saddle is open the hose can be laid in the peristaltic pump much more easily. In a variant which can be combined with all other embodiments disclosed in the present patent application, a plurality of pumps are arranged above one another, the drive thereof being able to be provided by way of hollow shafts. In particular in this case of a plurality of stacked pumps, opening the saddle makes the process of laying hoses in the pumps much simpler and faster.

There are various possible options for separating the two sub-portions of the saddle from one another. One option is to provide a linear guide along which the two sub-portions can slide relative to one another. In one embodiment, the use of a pivot axis, about which the sub-portions of the saddle are pivotable with respect to one another, is particularly preferred. In this case, the pivot axis is preferably in a dividing plane which extends through the saddle and divides it into the two sub-portions. Preferably, the pivot axis is positioned at the point in the separating plane which is at an at least virtually maximum distance from the rotor of the peristaltic pump. In this way, during pivoting about the pivot axis, a maximum possible distance between the sub-portions can be achieved. The sub-portions can preferably be removed sufficiently far from one another that the hose compression means emerge completely from the hose, so as to release the internal cross section thereof completely. Preferably, when the saddle is opening, the rotor is brought to an angular position such that the distance between the two hose compression means arranged closest to the pivot axis and the pivot axis is equal. It is thus provided, for example, that none of the hose compression means comes to be positioned directly in front of the pivot axis, where the opening effect due to pivoting is smallest. Instead, the distance for the two most critical hose compression means is therefore set to a maximum, in such a way that the hose can be released using as little pivoting movement as possible. Preferably, the pivot axis is positioned opposite the inlet and outlet region of the hose in the saddle. This has the advantage that the hose can be laid between the rotor and the inner saddle face in a particularly simple manner in the opening position.

Since the shaping of the inner saddle face is of particular significance, it is preferred for the pivot mechanism or a conceivable linearly movable opening mechanism to have a precision such that the position of the sub-portions with respect to one another is sufficiently accurately reproducible when the saddle is closed, preferably to a precision of less than 5/100 mm or particularly preferably less than 2/100 mm. Preferably, the path deviation through the separation point in the closed position of the saddle is also less than 5/100 mm, particularly preferably less than 2/100 mm. Preferably, the saddle is provided with a fixing device which holds it in the closed position in such a way that in operation at least one of the aforementioned precision and reproducibility specifications is adhered to.

In one embodiment, the saddle may be separated and closed automatically. This applies irrespective of the type of movement mechanism for the separation. This type of automation of the opening and closing of the two sub-portions makes it possible to suspend the conveying effect of the pump and release the hose cross section independently of human intervention and also as rapidly as possible. The hose can thus be automatically rinsed when the sub-portions of the saddle are initially opened, and a rinsing fluid is subsequently pumped through the hose, and subsequently the sub-portions of the saddle are closed again so as to make further conveying possible using the pump.

A further aspect of the present invention proposes the use of a peristaltic pump according to any of the above-disclosed aspects for metering a conveying fluid. Since the peristaltic pumps according to the abovementioned aspects supress pulsation effects in the pumping medium, this results in particularly good metering precision.

Figure 2:
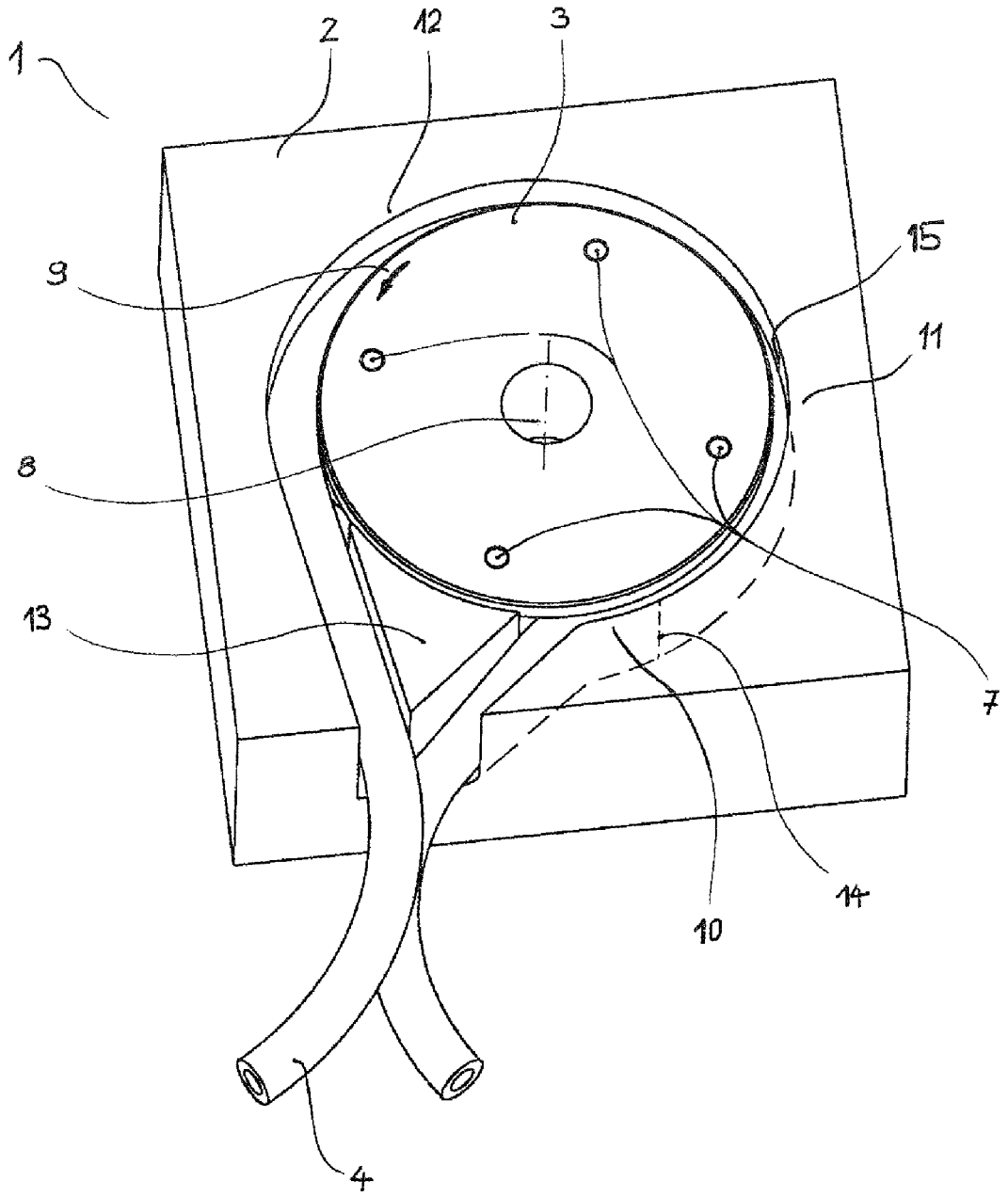
Figure 3:
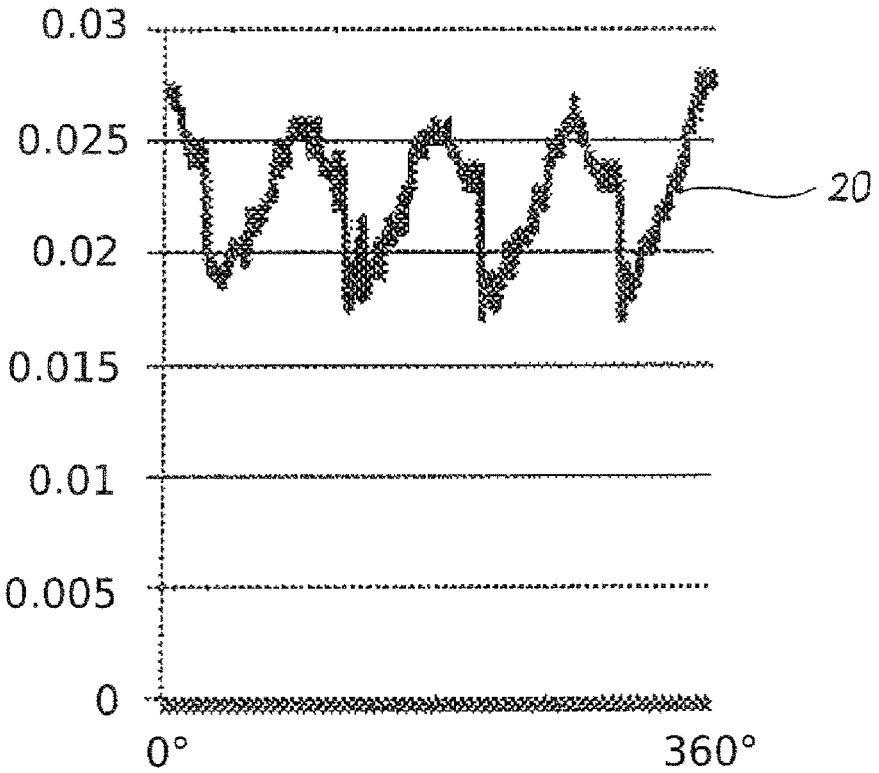
Fig. 3 Prior Art
Figure 4:
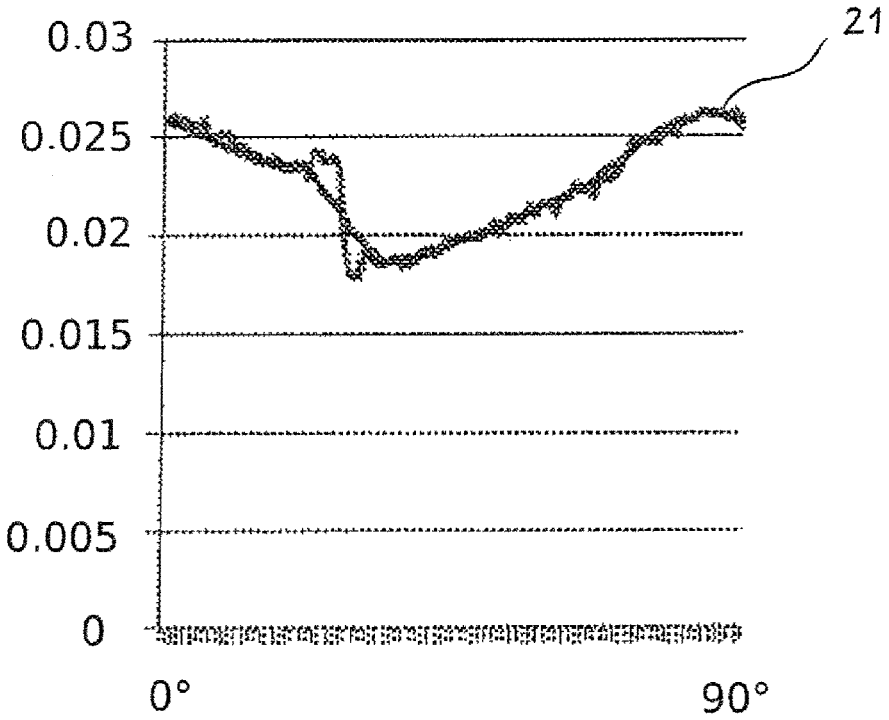
Figure 5:
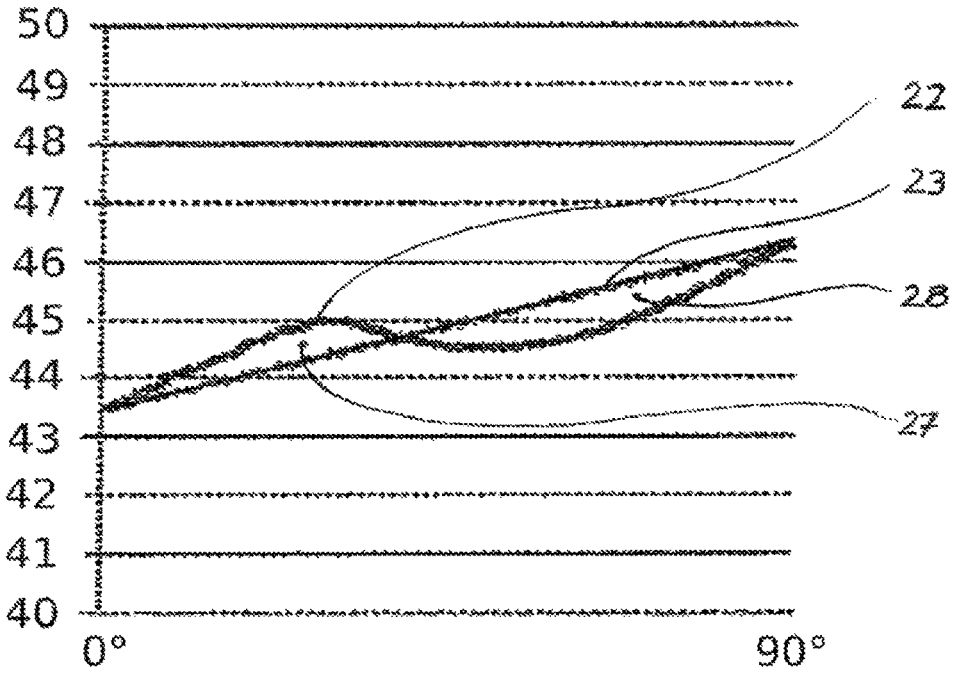
Figure 6:
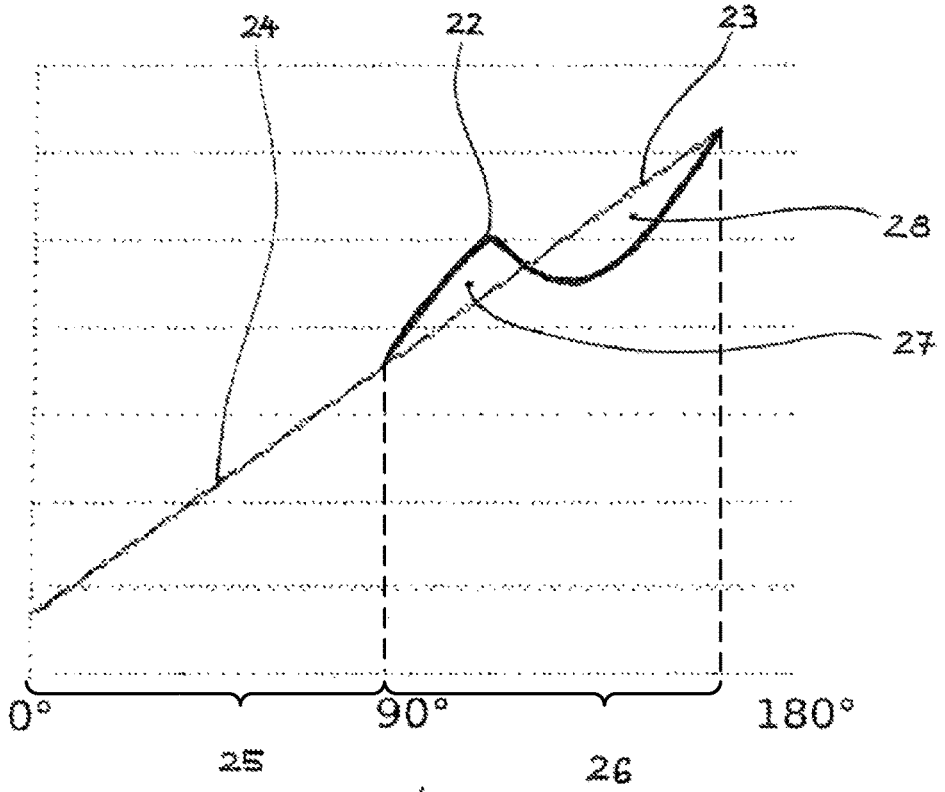
Figure 7:
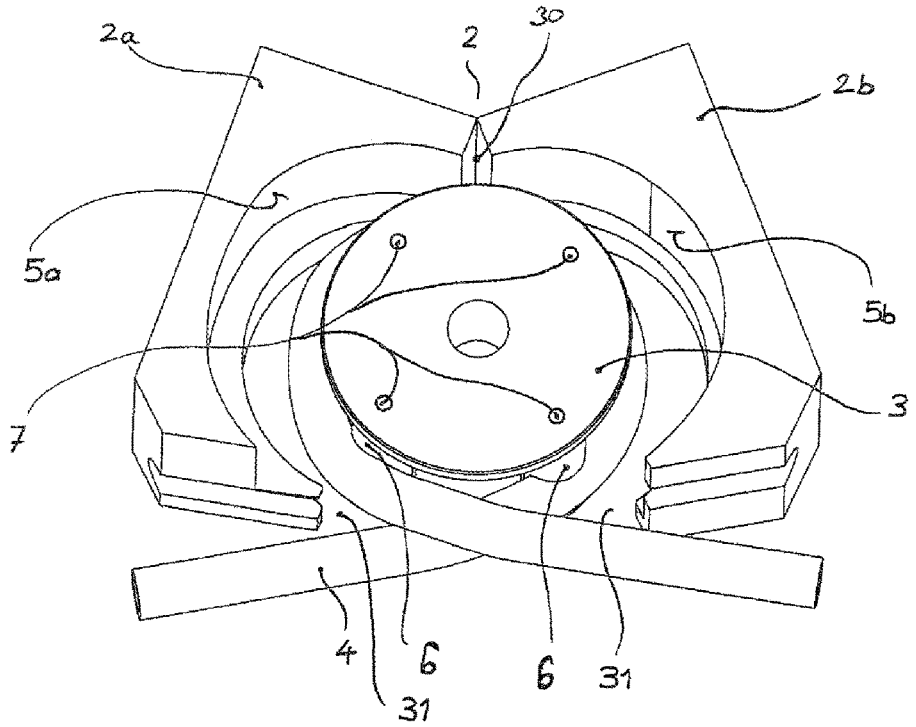
Figure 8:
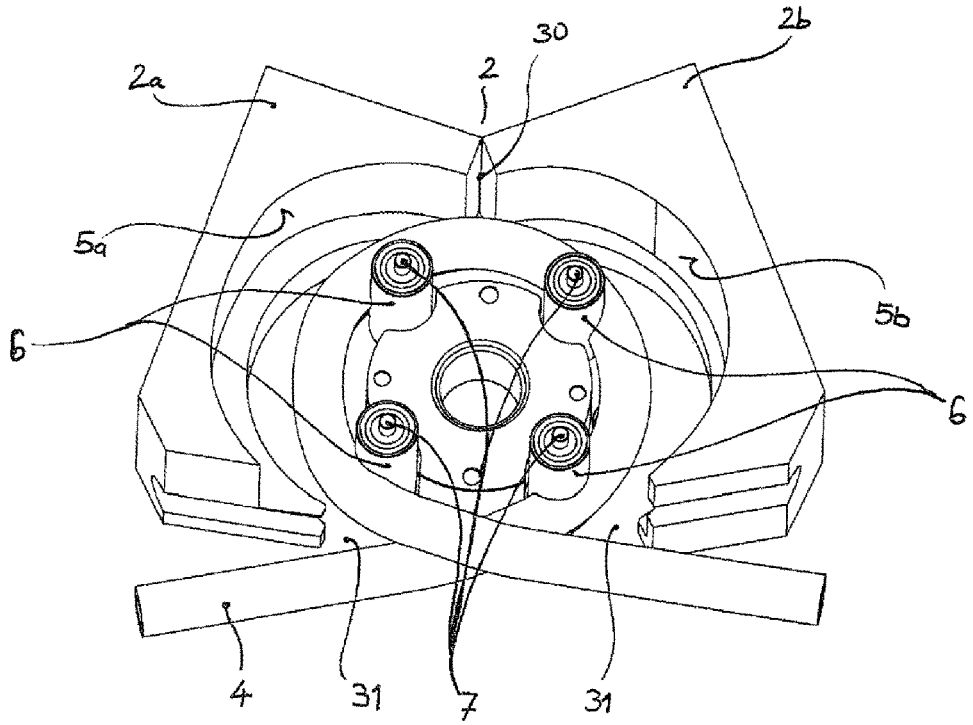
Figure 9A:
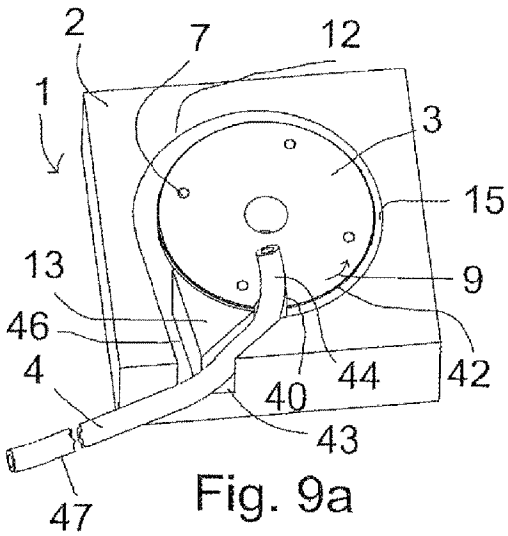
Figure 9B:
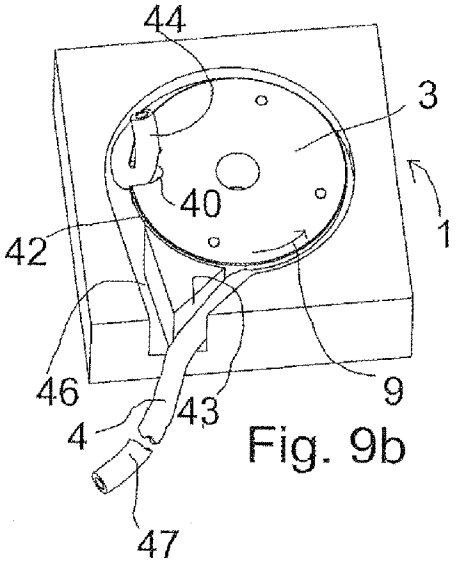
Figure 9C:
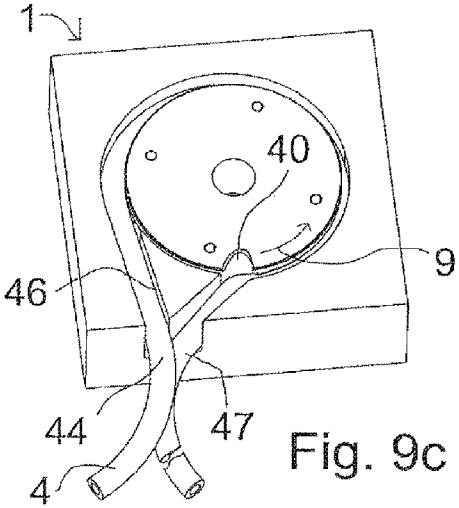
Figure 10:
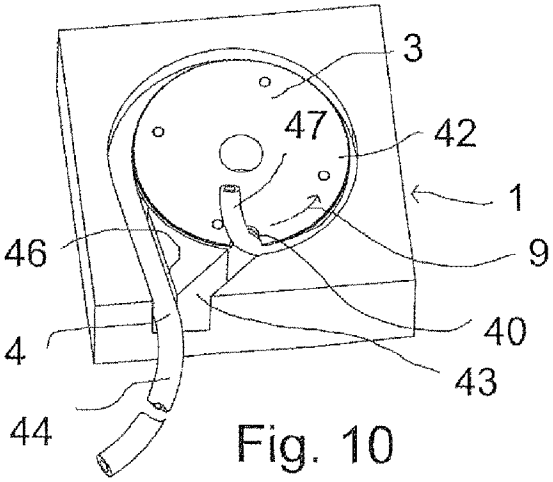

In the following, embodiments of the invention are described by way of example, with reference to the drawings, in which:

FIG. 1 is a perspective view of a peristaltic pump comprising a hose and having a high looping angle, FIG. 2 is a perspective view of another peristaltic pump comprising a hose and having a low looping angle, FIG. 3 is a graph of a progression of pulsation effects over a full rotation of a rotor, FIG. 4 is a graph showing a superposition of pulsation effects from a plurality of periods of the pulsation effects, FIG. 5 is a graph showing a correction shape, calculated from the pulsation, for an inner saddle face in a correction portion, FIG. 6 is a graph showing a progression of the distance between the inner saddle face and an axis of rotation of the rotor over an emergence region of the peristaltic pump, FIG. 7 is a schematic perspective view of an embodiment of the peristaltic pump having a divisible saddle, FIG. 8 is the same perspective view of the peristaltic pump of FIG. 7, but without parts of the rotor of the peristaltic pump which obscure the view of the hose compression means, FIG. 9*a*-9*c* are perspective views of three snapshots as a hose is threaded into a peristaltic pump of the construction shown in FIG. 2 having an additional threading clearance in the rotor, and FIG. 10 is a snapshot at the beginning of unthreading a hose from a peristaltic pump of the type also shown FIG. 9*a*-9*c*.

FIG. 1 is a perspective view of a peristaltic pump 1 comprising a saddle 2, in the inside of which a rotor 3 is arranged. A hose 4 is arranged in a gap between an inner saddle face 5 and a peripheral face of the rotor 3. Four hose compression means 6, which are largely covered by the rotor 3, are arranged at the periphery of the rotor 3. The hose compression means 6 are in the form of rollers, which are each rotatable about an axis 7 of the rotor. The hose compression means 6 engage in the hose 4 and compress it, in such a way that it is obturated at least at times upstream from a hose compression means 6. The hose 4 is arranged fixed in place in the saddle 2. During the rotation of the rotor 3, the hose compression means 6 run along the hose 4 and compress it upstream from the inner saddle face 5. The peristaltic pump 1 shown has a looping angle of virtually 360°, the ends of the hose 4 which exit the peristaltic pump 1 crossing one another in or shortly upstream from the peristaltic pump 1. The rotor 3 is rotatable about a theoretical axis of rotation 8, which extends through the centre thereof. The inner saddle face 5 is shaped in such a way that the radial distance therefrom, illustrated in FIG. 1 as the radial distance r, from the theoretical axis of rotation 8 of the rotor along the progression of the hose 4 upstream from the inner saddle face 5 is non-constant. The rotor 3 rotates in the direction of the arrow 9. The inner saddle face 5 is subdivided into an immersion region 10, a sealing region 11 and an emergence region 12, the emergence region 12 being downstream from the sealing region 11 which is itself downstream from the immersion region 10 in the direction of rotation 9. In the immersion region, the gap between the rotor 3 and the inner saddle face 5 narrows in the direction of rotation 9. The immersion region extends over approximately 30° to 40°, but not over more than 90°, of the inner saddle face. At the transition point 14, the immersion region 10 transitions into the sealing region 11. In the sealing region 11, the gap is of a substantially constant width, which is small enough to obturate the hose 4. At the transition point 15, the sealing region 11 transitions into the emergence region 12. The gap between the rotor 3 and the inner saddle face 5 widens in the direction of rotation 9 in the emergence region 12. The inner saddle face 5 ends close to the crossing of the hose 4. Starting, at the latest, from a hose compression means 6 reaching this end of the inner saddle face 5, the hose 4 is no longer compressed by the hose compression means 6. As it continues, the hose compression means 6 returns into the immersion region 10, where it strongly compresses the other end of the hose 4 until it obturates the hose 4 in the sealing region 11 and conveys conveying fluid located therein. In the transition of a hose compression means 6 from the immersion region 10 into the sealing region 11, a second hose compression means 6 simultaneously obturates the hose 4 within the sealing region 11, to ensure that there is no interruption to the conveyance in the transition. After a transition point to the emergence region 12 is reached, the second hose compression means 6 subsequently begins to emerge from the hose 4. Four hose compression means 6 are provided on the rotor 3. The angle of the emergence region 12 of the inner saddle face 5 is approximately 180° in this case, whilst the sealing region occupies at least 90° and the immersion region 10 occupies approximately 30° of the inner saddle face 5. In the emergence region 12, there are two hose compression means 6. In the sealing region 11, there is at least one hose compression means 6.

FIG. 2 is a perspective view of another peristaltic pump 1, which substantially corresponds to the peristaltic pump 1 shown in FIG. 1. Like features are denoted by like reference numerals. By contrast with the peristaltic pump shown in FIG. 1, the ends of the hose 4 of the peristaltic pump 1 shown in FIG. 2 do not cross within or shortly upstream from the pump. This results in a lower looping angle. However, the transition point 15 between the sealing region 11 and the emergence region 12 is arranged in such a way that the emergence region 12 further comprises approximately 180° of the inner saddle face 5. By contrast, the immersion region 10 and optionally the sealing region 11 each extend over a smaller angular range of the inner saddle face, the sealing region 11 not spanning less than 90°. A hose guidance portion 13, by means of which the ends of the hose 4 can be passed out of the saddle 2 in a defined manner, extends along a peripheral portion of the rotor 3.

FIG. 3 is a graph showing a pulsation effect of a volume flow from a prior-art peristaltic pump having emergence of the hose compression means from the hose which increases linearly over the angle of rotation of the rotor. The value of the volume flow is plotted on the y-axis, whilst the angle of the rotor 3 is plotted on the x-axis. The progression 20 is shown over a rotation of the rotor 3 from 0 to 360°. Corresponding to the four hose compression means 6 of the peristaltic pump 1, four approximately sinusoidal pulsations occur in the progression 20. The range shown is repeated for further rotations of the rotor 3.

FIG. 4 shows the individual pulsations of the progression 20 of FIG. 3 superposed in one graph. The value of the volume flow is again plotted on the x-axis, whilst an angular range from 0 to 90° in a rotation of the rotor 3 of a peristaltic pump, having emergence of the hose compression means from the hose increasing linearly over the angle of rotation of the rotor and in which the radius of the saddle increases linearly in the emergence region 12, is plotted on the y-axis. The rotor 3 of this pump comprises four hose compression means. The progression 21 shown is formed from a point cloud which results from corresponding translation and superposition of the pulsations into an angular range of 90°. This data set forms a basis for determining a modulation for the surface shape of the inner saddle face 5 for compensating the pulsations into the progressions 20 and 21. For a peristaltic pump having three hose compression means, the angular range shown would be smaller, since a larger proportion of the inner saddle face, namely at least 120°, is required for the sealing region. The progression of the volume flow occurring in a pump of this type would be similar, over the smaller angular range of the emergence region 12, to a compressed version of the progression shown over 90°.

FIG. 5 shows the progression 22 of a modulation for the emergence region 12 of the inner saddle face 5 by comparison with a progression 23 of the inner saddle face without modulation. The y-axis shows the distance between the inner saddle face and the axis of rotation 8 of the rotor 3 over an angle of rotation of the rotor 3 from 0 to 90° in the emergence region 12 for a variant having four hose compression means 6. In this case, the emergence region 12 is subdivided into two halves each having an angle of 90°. For a variant comprising three hose compression means 6, the emergence region 12 would turn out smaller, since the sealing region 11 only takes up at least 120°. From this point onwards, a rotor having four hose compression means will be discussed. Initially, as a result of the increased distance from the centre of rotation of the rotor in a first half-wave 27, the modulated progression 22 leads to a greater increase in the internal hose volume and a corresponding take-up of pumping medium. At an angle of rotation of the rotor of approximately 40°, the positive half-wave 27 transitions into a negative half-wave 28, which leads to a smaller volume increase by comparison with a continuous emergence of the hose compression means 6 from the hose 4. At the transition of the positive half-wave 27 into the negative half-wave 28, the hose, which is initially opened wider, is actually compressed again more strongly. In the half 25 (input portion) of the emergence region 12 which is passed through first in the direction of rotation 9 of the rotor 3, there is a continuous increase in the distance between the inner saddle face 5 and the axis of rotation 8 of the rotor 3. The graph of FIG. 5 shows the second half of the emergence region 12, which forms a compensation portion 26 and compensates pulsation effects from the input portion 25 of the emergence region 12 by way of a modulation 22. To arrive at the modulation 22 in FIG. 5 from the measured values of FIG. 4, initially an average of the pulsations superposed in FIG. 4 is taken. The values thus obtained are subsequently converted into the modulation 22 using a function which relates the distance between the inner saddle face 5 and the axis of rotation 8 of the rotor 3 with a change in volume flow. In addition, one conceivable way of doing this is to set a sine function 27, 28 and adapt the frequency, phase position, amplitude and offset thereof accordingly. Alternatively, a free curve form, which allows the best possible compensation, may be selected.

FIG. 6 is a graph having a y-axis showing the distance of the inner saddle face 5 from the axis of rotation 8 of the rotor 3 over an angular range from 0 to 180°. In the range from 0 to 90°, which corresponds to an input portion 25 or a first half of the emergence region 12, the distance between the inner saddle face 5 and the axis of rotation 8 of the rotor 3 increases linearly. From an angle of 90° to an angle of 180°, this corresponding to a compensation portion 26, a modulation 22, which compensates the pulsation effects from the input region 25 at least in part, is superposed on the linear increase in the distance between the inner saddle face 5 and the axis of rotation 8 of the rotor 3. The modulation 22 corresponds to the modulation 22 shown in FIG. 5 and is obtained in the same manner.

The compensation, disclosed in connection with FIGS. 3 to 6, of pulsation effects using two hose compression means 6 which run in an input portion 25 and a compensation portion 26 can be applied analogously to the compensation of the pulsation effects using a single hose compression means 6 in the emergence region 12. In this case, the entire emergence region 12 is corrected using a modulation 22 for a single hose compression means 6, no input portion 25 or compensation portion within the meaning of FIG. 6 being provided.

FIG. 7 shows an embodiment of a peristaltic pump which is of independent significance, and the right to claim this independently is reserved. In this embodiment, the saddle 2 can be subdivided into two sub-portions 2*a* and 2*b*, the portions 2*a* and 2*b* being arranged pivotably about a pivot axis 30. Pivoting the portions 2*a* and 2*b* open from a conveying position results in the inner saddle face being divided into two portions 5*a* and 5*b*, which are at a greater distance from one another when pivoted open than when closed. Moreover, the sub-portions of the inner saddle face 5*a* and 5*b* are each removed from the compression means 6, in such a way that the hose 4 is no longer clamped between the hose compression means 6 and the inner saddle face portions 5*a* and 5*b* in such a way that the hose is completely obturated. In this way, it is possible to suspend the conveying function of the peristaltic pump by opening the portions 5*a* and 5*b*. Moreover, as a result of the flow through the hose 4 being released, it is possible to rinse the hose, for example using a rinsing gas. Particularly preferably, the sub-portions 5*a* and 5*b* are removed sufficiently far from one another in an open position that the hose compression means 6 no longer press into the hose and thus the entire hose cross section is released. In this case the hose can be rinsed particularly well, in particular using a rinsing gas which is passed through. It is thus not necessary to rotate the rotor for rinsing. Preferably, the reproducibility of a closed position of the sub-portions 2*a* and 2*b* and/or a dimensional accuracy in spite of the separation point is better than 5/100 mm, preferably less than 2/100 mm. The points on the sub-portions 2*a* and 2*b* which are the furthest apart when the sub-portions 5*a* and 5*b* are pivoted are preferably at the exit point of the hose 4 from the saddle 2. The pivot axis 30 is thus preferably opposite the exit point 31. Preferably, an inlet region, a sealing region and an outlet region of the inner saddle face are configured as disclosed in one of the embodiments disclosed above in the present patent application. Preferably, the peristaltic pump is set up in such a way that when the saddle is opened the rotor 3 is brought into a position in which the hose compression means 6 are at an at least approximately maximum distance from the pivot axis 30. In this way, it can be provided that the small opening effect of the sub-portions 5*a* and 5*b* in the vicinity of the pivot axis 30 does not result in one of the hose compression means not emerging, barely emerging or incompletely emerging from the hose 4. For this purpose, in this position the hose compression means 6 are preferably at an angle to the pivot axis 30 corresponding to half of the angle between two hose compression means 6 on the rotor 3.

FIG. 8 shows the peristaltic pump of FIG. 7, with the difference that the rotor 3 is not shown. Thus, the view of four hose compression means 6, each configured as a roller, is revealed. The hose compression means 6 are each mounted around an axis of rotation 7 fixed in place in the rotor 3. Although the peristaltic pump is shown open, it is schematically shown how the hose compression means 6 are immersed into the hose 4. In reality, the inherent rigidity of the hose 4 would result in the hose being freed from the engagement of the hose compression means 6.

The peristaltic pump 1 shown in FIG. 9*a*-9*c* and FIG. 10 is of a construction of the type also shown in FIG. 2. In addition, the pump according to FIG. 9*a*-9*c* and 10 has a threading clearance 40 in the upper cover part 42 of the rotor 3. The threading clearance 40 is preferably large enough to be able to receive the hose cross section of the hose 4. To thread the hose 4 into the peristaltic pump 1, the threading clearance 40 is brought into alignment with the hose inlet duct 43 by rotating the rotor 3. Subsequently, a leading end portion 44 is laid in the hose inlet duct 43 and angled upwards in the region of the threading clearance 40 in the manner shown in FIG. 9*a*, and thus laid in the threading clearance 40 in part. Subsequently, the rotor 3 is rotated in the direction of the arrow 9, and in the process the hose 4 is entrained and pulled along as a result of the engagement in the threading clearance 40. For this purpose, the leading end portion 44 may optionally be held by an operator until the rotor 3 has rotated far enough for the hose 4 to have reached the hose outlet duct 46. FIG. 9*b* is a snapshot on the way thereto. In FIG. 9*c*, the hose 4 is already fully threaded, in such a way that it is in the operating position thereof between the inner saddle face 15 and the peripheral face of the rotor 3 in the region below the cover part 42 of the rotor 3. The cover part 42 protrudes radially outwards past said peripheral face of the rotor 3, in such a way that the hose 4 cannot fall out of the pump 1 in the axial direction of the rotor 3.

In the target position shown in FIG. 9*c* of the hose 4, the threading clearance 40 is free again and the leading portion 44 of the hose is positioned in the hose outlet duct 46 in part.

The aspect of providing a radially external threading clearance of the rotor can also be beneficial and make simplified threading of the hose possible in peristaltic pumps other than those considered herein. This aspect may thus be of inventive significance in peristaltic pumps in general independently of the configuration considered in greater detail herein of the saddle of the peristaltic pump.

FIG. 10 is a snapshot during the unthreading of the hose 4. In this context, the trailing end portion 47 of the hose is bent upwards, in such a way that it is received in the threading clearance 40. Subsequently, the rotor 3 can be rotated in the direction of the arrow 9 and in the process the hose 4 can be slid out of the outlet duct 46 until the trailing end 47 is finally released from the threading clearance 40 and the hose as a whole can be removed from the peristaltic pump 1.

The invention claimed is:

1. A peristaltic pump for conveying a fluid pumping medium through a hose, comprising:

a saddle having an arc-shaped inner saddle face and a rotor that is arranged in the saddle so the rotor can rotate about an axis of rotation, the rotor having a plurality of hose compression means that are angularly distributed around the axis of rotation and arranged opposing the arc-shaped inner saddle face at least at times, for externally loading the hose, which is arranged between the arc-shaped inner saddle face and the rotor, in such a way that when the rotor rotates a particular local constriction of the throughput cross section of the hose, which is caused by external loading of the hose by a hose compression means, wherein the hose is movable along the arc-shaped inner saddle face using the relevant hose compression means so as to convey the pumping medium in the hose, the saddle comprising, along the arc-shaped inner saddle face, an immersion region, a sealing region and an emergence region for the hose compression means, and a radial distance between the axis of rotation of the rotor and the arc-shaped inner saddle face decreasing in the immersion region, staying constant in the sealing region and increasing on the average in the emergence region in such a way that the hose compression means, during the movement through the immersion region, can increasingly load the hose so as to constrict the throughput cross section thereof, and, during the movement through the emergence region, can relieve the hose to remove or at least reduce the particular constriction, wherein the hose compression means are provided so as to be angularly spaced on the rotor in such a way, and the emergence region extends around the axis of rotation of the rotor over such an angular range with the length of the emergence region being twice the minimal angular distance between two hose compression means in the rotor, that two hose compression means in succession are in the emergence region during the rotation of the rotor, the arc-shaped inner saddle face extending in the emergence region in such a way that the radial distance between the arc-shaped inner saddle face and the axis of rotation of the rotor varies along a movement path of the hose compression means with at least one area of the emergence region having a decreasing radial distance in a direction of the movement path, the saddle having a substantially square profile with the axis of rotation of the rotor located at a center of the substantially square profile, a longitudinal axis perpendicular to the axis of rotation of the rotor, and a hose guidance portion located at a bottom portion of the substantially square profile, the hose being positioned in the saddle and having a low-looping angle such that ends of the hose exiting the peristaltic pump are located adjacent to each other but do not cross within the substantially square profile, and wherein a transition point of the movement path where the immersion region transitions into the sealing region is in the bottom portion on an opposite side of the longitudinal axis than the hose guidance portion.

2. The peristaltic pump according to claim 1, wherein the saddle comprises, along the arc-shaped inner saddle face, an input portion of the emergence region, which is passed through by one of the two successive hose compression means, the radial distance between the arc-shaped inner saddle face and the axis of rotation of the rotor increasing continuously along the input portion, and a compensation portion, which, simultaneously with the input portion being passed through by one of the two successive hose compression means, is passed through by the other of the two successive hose compression means, wherein a variation of the arc-shaped inner saddle face in the emergence region along the movement path for compensating pulsations is in the compensation portion of the emergence region, and wherein the compensation portion comprises the at least one area of the emergence region having the decreasing radial distance.

3. The peristaltic pump according to claim 2, wherein the sealing region has a constant radial distance between the axis of rotation of the rotor and the arc-shaped inner saddle face, the input portion, and the compensation portion are dimensioned in such a way that they are passed through simultaneously and without interruption by respective hose compression means when the rotor rotates, one of the hose compression means being able to load the hose in each of the sealing region, the input portion and the compensation portion.

4. The peristaltic pump according to claim 3, wherein the sealing region, the input portion and the compensation portion extend around the axis of rotation of the rotor over equally large angular distances.

5. The peristaltic pump according to claim 2, wherein the input portion is arranged in the emergence region in such a way that it is passed through by the hose compression means upstream from the compensation portion in the direction of rotation of the rotor.

6. The peristaltic pump according to claim 2, wherein a variation of the radial distance between the arc-shaped inner saddle face and the axis of rotation of the rotor along the compensation portion is established by way of a measurement on a conventional peristaltic pump without variation of the radial distance in the compensation portion and with the conventional peristaltic pump having all features of the peristaltic pump except for having an emergence region with a continuous linear increase of the radial distance between the axis of rotation of the rotor, in such a way that pulsation effects in the pumping medium measured on the conventional peristaltic pump without variation of the radial distance in the compensation portion are compensated by counteracting the variation of the radial distance in the compensation portion in the peristaltic pump.

7. The peristaltic pump according to claim 6, wherein for the measurement the conventional peristaltic pump is arranged with a hose of a hose type, so that the variation of the radial distance is specifically adjusted to said hose type in the peristaltic pump.

8. The peristaltic pump according to claim 1, wherein the distances of the hose compression means in the rotor from the axis of rotation of the rotor are constant.

9. The use of a peristaltic pump according to claim 1 for metering a conveying fluid.

10. A peristaltic pump for conveying a fluid pumping medium through a hose, comprising:

a saddle having an arc-shaped inner saddle face and a rotor that is arranged in the saddle so it can rotate about an axis of rotation, the rotor having a plurality of hose compression means that are angularly distributed around the axis of rotation and arranged opposing the arc-shaped inner saddle face at least at times, for externally loading the hose, which is to be arranged between the arc-shaped inner saddle face and the rotor, in such a way that when the rotor rotates a particular local constriction of the throughput cross section of the hose, which is caused by external loading of the hose by a hose compression means, is movable along the arc-shaped inner saddle face using the relevant hose compression means so as to convey the pumping medium in the hose, the saddle comprising, along the arc-shaped inner saddle face, an immersion region, a sealing region and an emergence region for the hose compression means, and a radial distance between the axis of rotation of the rotor and the arc-shaped inner saddle face decreasing in the immersion region, staying constant in the sealing region and increasing in the emergence region in such a way that the hose compression means, during the movement thereof through the immersion region, can increasingly load the hose so as to constrict the throughput cross section thereof, and, during the movement thereof through the emergence region, can relieve the hose to remove or at least reduce the particular constriction, the hose compression means are provided so as to be angularly spaced on the rotor in such a way, and the emergence region extends around the axis of rotation of the rotor over such an angular range, that a hose compression means is in the emergence region during the rotation of the rotor, the arc-shaped inner saddle face extending in the emergence region in such a way that the radial distance between the arc-shaped inner saddle face and the axis of rotation of the rotor varies along a movement path of the hose compression means in such a way that the load on the hose from the hose compression means is varied upon passing through the emergence region, in such a way that the internal volume of the hose at a point of a load from the hose compression means increases uniformly, the hose compression means being distributed around the axis of rotation of the rotor at equal angular distances from one another, and the length of the emergence region being twice the minimal angular distance between two hose compression means in the rotor, the saddle having a substantially square profile with the axis of rotation of the rotor located at a center of the substantially square profile, a longitudinal axis perpendicular to the axis of rotation of the rotor, and a hose guidance portion located at a bottom portion of the substantially square profile, the hose being positioned in the saddle and having a low-looping angle such that ends of the hose exiting the peristaltic pump are located adjacent to each other but do not cross within the substantially square profile, and wherein a transition point of the movement path where the immersion region transitions into the sealing region is in the bottom portion on an opposite side of the longitudinal axis than the hose guidance portion.

11. The peristaltic pump according to claim 10, wherein a variation of the radial distance between the inner saddle face and the axis of rotation of the rotor is established by a measurement on a conventional peristaltic pump lacking variation of the inner saddle face and with the conventional peristaltic pump having all features of the peristaltic pump except for having an emergence region with a continuous linear increase of the radial distance between the axis of rotation of the rotor, in such a way that pulsation effects in the pumping medium measured on the conventional peristaltic pump without variation are compensated by counteracting the variation.

* * * * *